US011081837B2

(12) United States Patent
He et al.

(10) Patent No.: US 11,081,837 B2
(45) Date of Patent: Aug. 3, 2021

(54) MULTI CORE PLUG IN ELECTRICAL CONNECTION STRUCTURE FOR LOGGING WHILE DRILLING TOOLS

(71) Applicant: Institute of Geology and Geophysics, Chinese Academy of Sciences, Beijing (CN)

(72) Inventors: Xinzhen He, Beijing (CN); Qingyun Di, Beijing (CN)

(73) Assignee: INSTITUTE OF GEOLOGY AND GEOPHYSICS, CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 17/174,288

(22) Filed: Feb. 11, 2021

(65) Prior Publication Data

US 2021/0167551 A1 Jun. 3, 2021

Related U.S. Application Data

(63) Continuation-in-part of application No. PCT/CN2020/084180, filed on Apr. 10, 2020.

(30) Foreign Application Priority Data

Apr. 18, 2019 (CN) ..... 201910314133.9

(51) Int. Cl.
*H01R 13/631* (2006.01)
*E21B 17/02* (2006.01)
(Continued)

(52) U.S. Cl.
CPC ..... *H01R 13/631* (2013.01); *E21B 17/028* (2013.01); *H01R 13/502* (2013.01); *H01R 13/516* (2013.01); *H01R 13/639* (2013.01)

(58) Field of Classification Search
CPC .. H01R 13/631; H01R 13/502; H01R 13/516; H01R 13/639; E21B 17/028
See application file for complete search history.

(56) References Cited

U.S. PATENT DOCUMENTS 4,886,463 A * 12/1989 Scott ..... H01R 13/6583 439/89
5,755,589 A * 5/1998 Koch ..... H01R 13/582 439/427
(Continued)

FOREIGN PATENT DOCUMENTS

CN 102400671 A 4/2012
CN 102819071 A 12/2012
(Continued)

*Primary Examiner* — Abdullah A Riyami
*Assistant Examiner* — Nader J Alhawamdeh
(74) *Attorney, Agent, or Firm* — Novick, Kim & Lee, PLLC; Allen Xue

(57) ABSTRACT

The present invention relates to multi-core plug-in electrical connection structures, in particular to a multi-core plug-in electrical connection structure for logging while drilling tools, which comprises a socket shell with a guiding function arranged at an end of a logging while drilling tool A and a plug shell with a guiding function arranged at an end of a logging while drilling tool B; wherein the socket shell is provided with a socket inner core with a buffering effect therein; and the plug shell is provided with a plug inner core with a buffering effect therein. The present invention has the following beneficial effects: with the above technical scheme, multi-core electrical connection between downhole logging while drilling tools can be achieved, the electrical connection pins can be increased to 25 pins or more, mixed heavy current and light current connections can be realized, and the electrical connection structure is simple with short
(Continued)

A-A axial dimension, good anti-vibration performance, and reliable connection. The blind insertion and the convenient connection can be realized.

7 Claims, 4 Drawing Sheets

(51) Int. Cl.

| | |
|---|---|
| ***H01R 13/502*** | (2006.01) |
| ***H01R 13/516*** | (2006.01) |
| ***H01R 13/639*** | (2006.01) |

(56) References Cited

U.S. PATENT DOCUMENTS

| | | | | |
|---|---|---|---|---|
| 6,455,779 | B1 * | 9/2002 | Jones | H01R 4/72 174/93 |
| 10,361,512 | B2 * | 7/2019 | Seido | H01R 13/62922 |
| 10,581,198 | B2 * | 3/2020 | Seido | H01R 13/631 |
| 2015/0110444 | A1 * | 4/2015 | Tanaka | G02B 6/3817 385/75 |
| 2017/0062978 | A1 * | 3/2017 | Seido | H01R 13/62922 |
| 2017/0244449 | A1 * | 8/2017 | Pape | H01R 24/42 |

FOREIGN PATENT DOCUMENTS

| | | | | |
|---|---|---|---|---|
| CN | 104300302 | A | 1/2015 | |
| CN | 204333452 | U | 5/2015 | |
| CN | 106887736 | A | 6/2017 | |
| CN | 207409744 | U | 5/2018 | |
| CN | 207701127 | U | 8/2018 | |
| CN | 109888563 | A | 6/2019 | |
| DE | 19617201 | A1 * | 11/1997 | H01R 13/642 |

* cited by examiner

MULTI CORE PLUG IN ELECTRICAL CONNECTION STRUCTURE FOR LOGGING WHILE DRILLING TOOLS

TECHNICAL FIELD

The present invention relates to multi-core plug-in electrical connection structures, in particular to a multi-core plug-in electrical connection structure for logging while drilling tools.

BACKGROUND ART

Presently, more and more types of logging while drilling tools are available, and there are more and more requirements for communication and power supply among logging while drilling tools. Therefore, reliable electrical connections among logging while drilling tools have become an urgent problem to be solved. Especially, multi-core and mixed heavy current and light current connections have become a challenge, and involve problems of long axial dimension, poor anti-vibration performance, inability for blind insertion, inconvenient connection, etc.

CONTENTS OF THE INVENTION

The embodiments of the present disclosure disclose a multi-core plug-in electrical connection structure for logging while drilling tools, in order to solve any of the above problems and other potential problems in the prior Art.

To attain the above object, the embodiments of the present disclosure disclose a multi-core plug-in electrical connection structure for logging while drilling tools, which comprises a socket shell with a guiding function arranged at a connecting end of a first logging while drilling tool and a plug shell with a guiding function arranged at a connecting end of a second logging while drilling tool; wherein the socket shell is provided with a socket inner core with a buffering effect therein; and the plug shell is provided with a plug inner core with a buffering effect.

According to an embodiment of the present disclosure, the multi-core plug-in electrical connection structure further comprises a pressure-resistant shell for protecting the multi-core plug-in electrical connection structure, which is sleeved outside the entire plug-in electrical connection structure, with two ends respectively sealed with an end of a first logging while drilling tool and an end of a second logging while drilling tool by rubber seal rings.

According to an embodiment of the present disclosure, the multi-core plug-in electrical connection structure is specifically characterized in: the socket inner core is mounted inside the socket shell via a first flexible connection assembly, and the plug inner core is mounted inside the plug shell via a second flexible connection assembly, and the socket inner core and the socket shell as well as the plug inner core and the plug shell are positioned with respect to each other by a positioning key and a positioning keyway respectively;

a socket guide slot is arranged on the side wall of an end of the socket shell, and a plug guide to be fitted with the socket guide slot is arranged on the side wall of an end of the plug shell opposite to the socket shell.

According to an embodiment of the present disclosure, an end of the plug guide is provided with a circumferential guide bevel for guiding in the circumferential direction in a process of blind insertion of the plug into the socket and a radial guide bevel for guiding in the radial direction in the process of blind insertion of the plug into the socket, the included angle between the circumferential guide bevel and the horizontal direction is 0-15°, the length of the circumferential guide bevel in the horizontal direction is 15-20 mm, the included angle between the radial guide bevel and the horizontal direction is 0-10°, and the length of the radial guide bevel in the horizontal direction is not smaller than 15 mm.

According to an embodiment of the present disclosure, the bottom of the socket guide slot is provided with a socket guide bevel for guiding in the radial direction in the process of blind insertion of the plug into the socket, the included angle between the socket guide bevel and the horizontal direction is 15-25°, and the length of the socket guide bevel in the horizontal direction is 5-10 mm.

According to an embodiment of the present disclosure, the first flexible connection assembly comprises a first top ring, a first wave spring and a first locking nut;

the first locking nut is arranged inside the tail end of the socket shell, one end of the first wave spring is fixedly connected with the first locking nut, one end of the first top ring is fixedly connected with the other end of the first wave spring, and the tail end of the socket inner core is fixedly connected with the other end of the first top ring;

the second flexible connection assembly comprises a second top ring, a second wave spring and a second locking nut;

the second locking nut is arranged inside the tail end of the plug shell, one end of the second wave spring is fixedly connected with the second locking nut, one end of the second top ring is fixedly connected with the other end of the second wave spring, and the tail end of the plug inner core is fixedly connected with the other end of the second top ring.

According to an embodiment of the present disclosure, the compression amount of both the first wave spring and the second wave spring is 3-5 mm, which generating 100-180 N pre-tightening pressure.

According to an embodiment of the present disclosure, the socket shell and the plug shell are made of a structural steel material, which can provide sufficient guiding force when it takes a guiding effect.

According to an embodiment of the present disclosure, the pressure-resistant shell is made of a structural steel material.

The present invention has the following beneficial effects: with the above technical scheme, multi-core electrical connection between downhole logging while drilling tools can be achieved, the electrical connection pins can be increased to 25 pins or more, mixed heavy current and light current connections can be realized, and the electrical connection structure is simple with short axial dimension, good anti-vibration performance, and reliable connection. The blind insertion and the convenient connection can be realized.

Figure 1:
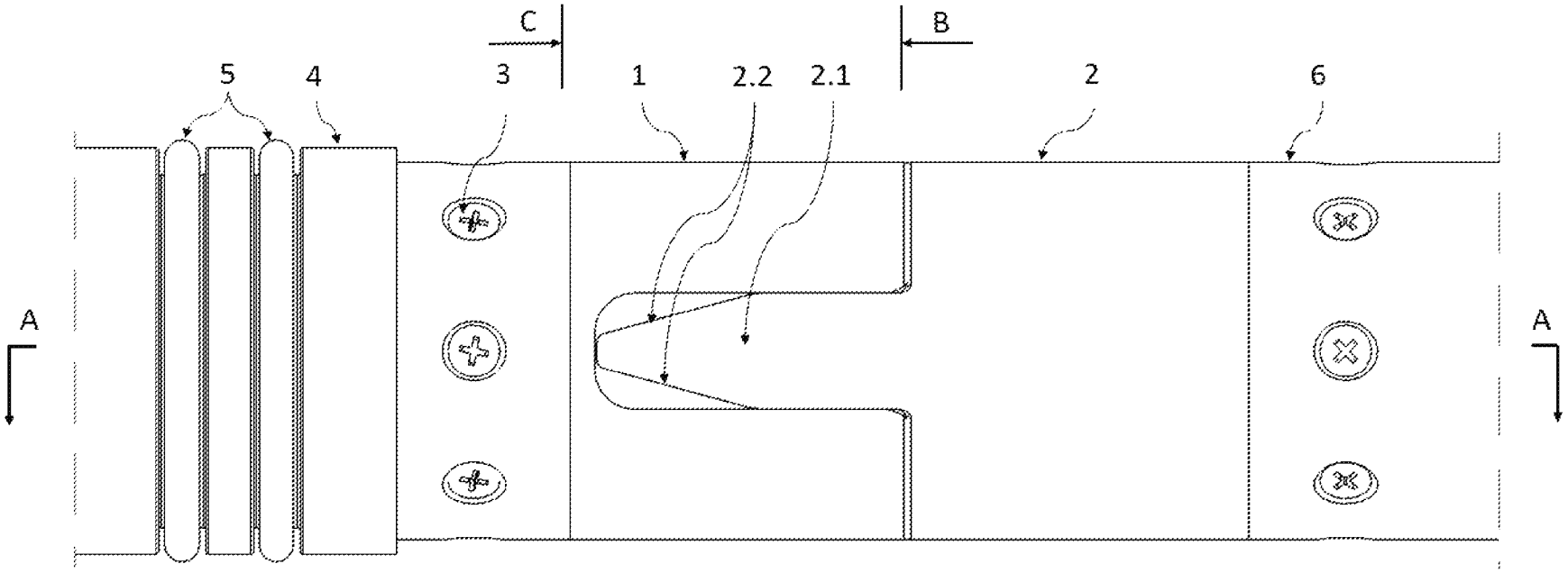
FIG. 1 is a schematic external structural diagram of the multi-core plug-in electrical connection structure for logging while drilling tools according to the present invention.
Figure 2:
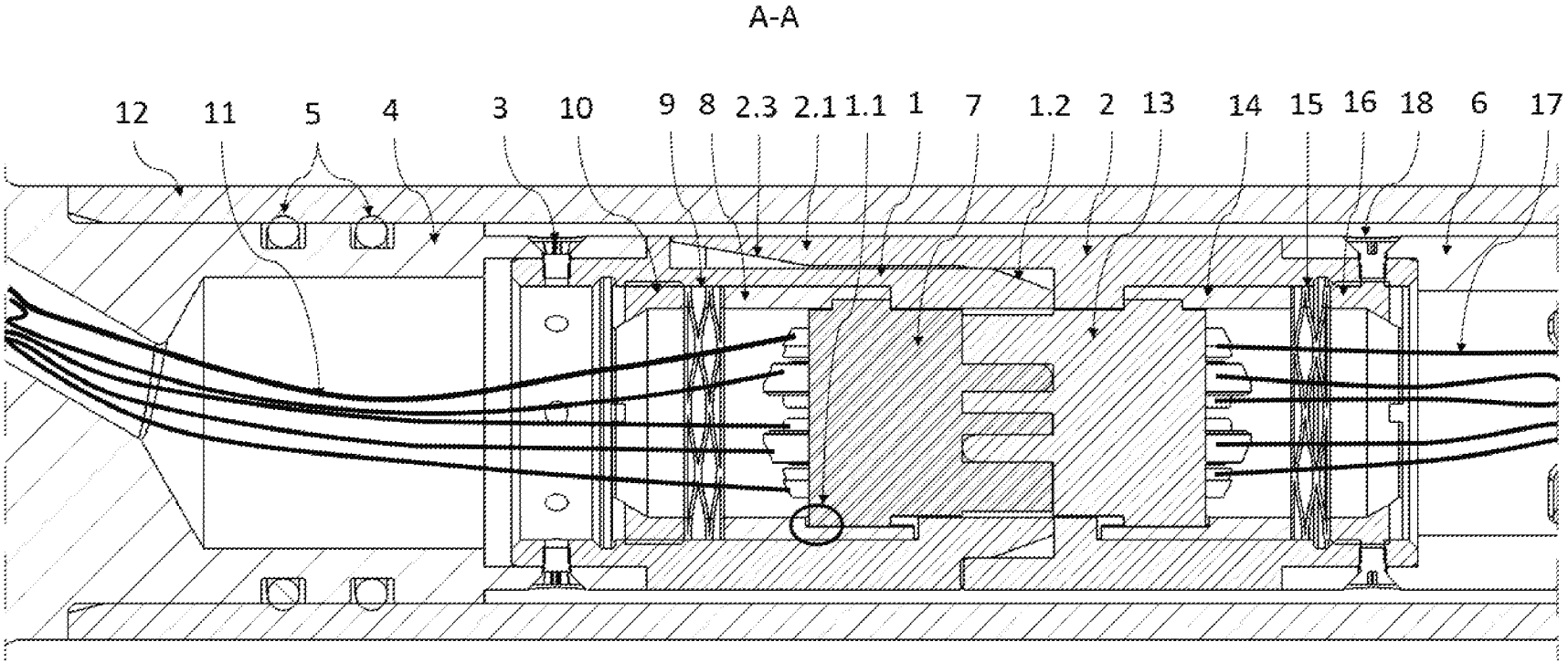
FIG. 2 is a schematic internal cross-sectional view of the multi-core plug-in electrical connection structure for logging while drilling tools according to the present invention.
Figure 3:
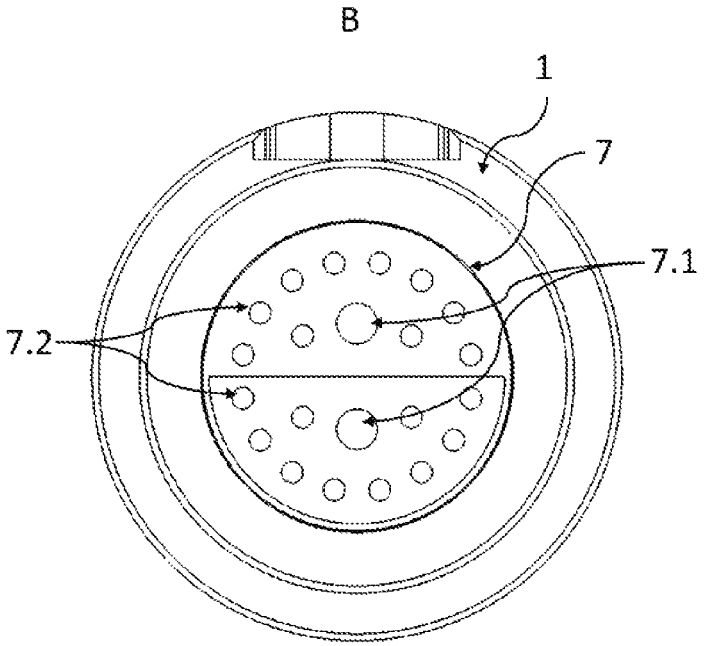
FIG. 3 is a schematic structural diagram of the socket part of the multi-core plug-in electrical connection structure for logging while drilling tools according to the present invention.
Figure 4:
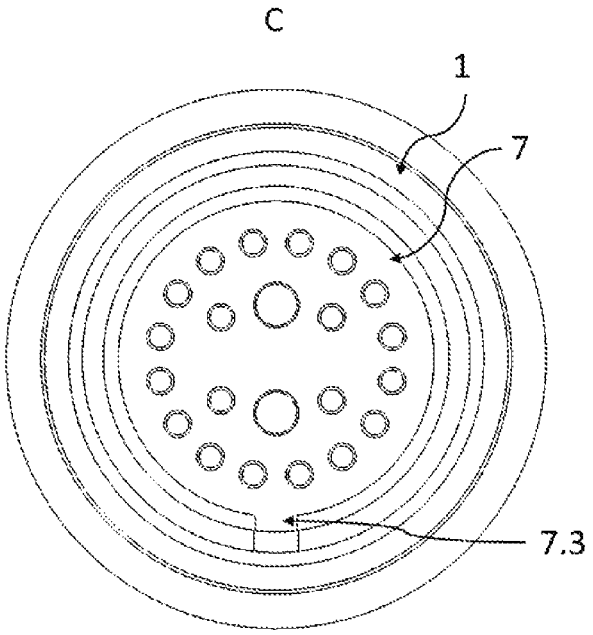
FIG. 4 is a schematic structural diagram of the plug part of the multi-core plug-in electrical connection structure for logging while drilling tools according to the present invention.

1—socket shell; 1.1—positioning keyway; 1.2—socket guide bevel; 1.3—socket guide slot; 2—plug shell; 2.1—plug guide; 2.2—circumferential guide bevel; 2.3—radial guide bevel; 3—first fastening screw; 4—first logging while drilling tool; 5—rubber seal ring; 6—second logging while drilling tool; 7—socket inner core; 7.1—heavy current pin jack; 7.2—light current pin jack; 7.3—positioning key; 8—first top ring; 9—first wave spring; 10—first locking nut; 11—first wire harness; 12—pressure-resistant shell; 13—plug inner core; 14—second top ring; 15—second wave spring; 16—second locking nut; 17—second wire harness; 18—second fastening screw

EMBODIMENTS

Hereunder the technical scheme of the present invention will be further detailed with reference to the accompanying drawings.

As shown in FIGS. 1-4, The multi-core plug-in electrical connection structure for logging while drilling tools according to the present invention comprises a socket shell with a guiding function arranged at a connecting end of a first logging while drilling tool and a plug shell with a guiding function arranged at a connecting end of a second logging while drilling tool; wherein the socket shell is provided with a socket inner core with a buffering effect therein; and the plug shell is provided with a plug inner core with a buffering effect.

According to an embodiment of the present disclosure, the multi-core plug-in electrical connection structure further comprises a pressure-resistant shell for protecting the multi-core plug-in electrical connection structure, which is sleeved outside the entire plug-in electrical connection structure, with two ends respectively sealed with an end of a first logging while drilling tool and an end of a second logging while drilling tool by rubber seal rings.

According to an embodiment of the present disclosure, the multi-core plug-in electrical connection structure is specifically characterized in: the socket inner core is mounted inside the socket shell via a first flexible connection assembly, and the plug inner core is mounted inside the plug shell via a second flexible connection assembly, and the socket inner core and the socket shell as well as the plug inner core and the plug shell are positioned with respect to each other by a positioning key and a positioning keyway respectively; a socket guide slot is arranged on the side wall of an end of the socket shell, and a plug guide to be fitted with the socket guide slot is arranged on the side wall of an end of the plug shell opposite to the socket shell.

According to an embodiment of the present disclosure, an end of the plug guide is provided with a circumferential guide bevel for guiding in the circumferential direction in a process of blind insertion of the plug into the socket and a radial guide bevel for guiding in the radial direction in the process of blind insertion of the plug into the socket, the included angle between the circumferential guide bevel and the horizontal direction is 0-15°, the length of the circumferential guide bevel in the horizontal direction is 15-20 mm, the included angle between the radial guide bevel and the horizontal direction is 0-10°, and the length of the radial guide bevel in the horizontal direction is not smaller than 15 mm.

According to an embodiment of the present disclosure, the bottom of the socket guide slot is provided with a socket guide bevel for guiding in the radial direction in the process of blind insertion of the plug into the socket, the included angle between the socket guide bevel and the horizontal direction is 15-25°, and the length of the socket guide bevel in the horizontal direction is 5-10 mm.

According to an embodiment of the present disclosure, the first flexible connection assembly comprises a first top ring, a first wave spring and a first locking nut;

the first locking nut is arranged inside the tail end of the socket shell, one end of the first wave spring is fixedly connected with the first locking nut, one end of the first top ring is fixedly connected with the other end of the first wave spring, and the tail end of the socket inner core is fixedly connected with the other end of the first top ring;

the second flexible connection assembly comprises a second top ring, a second wave spring and a second locking nut;

the second locking nut is arranged inside the tail end of the plug shell, one end of the second wave spring is fixedly connected with the second locking nut, one end of the second top ring is fixedly connected with the other end of the second wave spring, and the tail end of the plug inner core is fixedly connected with the other end of the second top ring.

According to an embodiment of the present disclosure, the compression amount of both the first wave spring and the second wave spring is 3-5 mm, which generating 100-180 N pre-tightening pressure.

According to an embodiment of the present disclosure, the socket shell and the plug shell are made of a structural steel material, which can provide sufficient guiding force when it takes a guiding effect.

According to an embodiment of the present disclosure, the pressure-resistant shell is made of a structural steel material.

The plug-in electrical connection structure provided in the present invention is direction-insensitive, which is to say, the plug and the socket may be interchanged and connected to any logging while drilling tool according to the actual requirement.

The number of the connector pins may be selected according to the specific requirement, and, in doing so, only the socket inner core 7 and the matching plug inner core 13 have to be replaced; in addition, the number of heavy current pins and the number of light current pins may be adjusted and selected according to the specific requirement.

The plug-in electrical connection structure mainly comprises a socket shell 1, a socket inner core 7, a plug shell 2, a plug inner core 13, a first top ring 8, a first wave spring 9, and a first locking nut 10, etc.

The socket shell 1 is connected with a logging while drilling tool A by eight first fastening screws 3 evenly distributed on the circumference, the socket inner core 7 is mounted in the socket shell 1, and the first locking nut 10 presses the first wave spring 9, which preloads the first top ring 8 so as to press the socket inner core 7 in the socket shell 1; the tail portion of the socket inner core is provided with a positioning key 7.3, and the socket shell 1 is provided with a positioning keyway 1.1, which is connected via the first top ring 8 so as to position the socket inner core 7 in the circumferential direction and prevent the socket inner core 7 from rotating in the socket shell 1.

The first locking nut 10 is connected with the socket shell 1 via threads to pre-tighten the first wave spring 9. After pre-tightening, the wave spring generates about 140 N force. The wave spring has certain compression margin to protect the socket inner core 7 and prevent the contact pins from damaged due to excessive force when the plug is inserted into the socket as well as ensure reliable electrical connection between the socket and the plug in the downhole environment with strong vibration and shock.

The socket shell 1 is designed with a socket guide bevel 1.2, the included angle between the socket guide bevel and the horizontal direction is 15-25°, and the length of the socket guide bevel in the horizontal direction is 5-10 mm, for guiding in the radial direction in the process of blind insertion of the plug into the socket.

A welding cup is arranged at the tail portion of the socket inner core 7 and is connected with the inside of the logging while drilling tool A by welding a first wire harness 11.

The plug shell 2 is connected with a drilling instrument B by eight second fastening screws 18 evenly distributed on the circumference, the plug inner core 13 is installed in the plug shell 2, and a second locking nut 16 presses a second wave spring 15, which preloads a top ring 14 so as to press the plug inner core 13 is in the plug shell 2; the tail portion of the plug inner core is provided with a positioning key, the plug shell 2 is provided with a positioning keyway and is connected via the second top ring 14 so as to position the plug inner core 13 in the circumferential direction and prevent the plug inner core 13 is from rotating in the plug shell 2.

The plug shell 2 is designed with a plug guide 2.1, which has a circumferential guide bevel 2.2, the included angle between the guide bevel and the horizontal direction is 15°, and the length of the guide bevel in the horizontal direction is 15-20 mm, for guiding in the circumferential direction in the process of blind insertion of the plug into the socket. The plug guide 2.1 has a radial guide bevel 2.3, the angle between the guide bevel and the horizontal direction is 10°, and the length of the guide bevel in the horizontal direction is 15 mm, for guiding in the radial direction in the process of blind insertion of the plug into the socket.

A welding cup is arranged at the tail portion of the plug inner core 13 and is connected with the inside of the logging while drilling tool B by welding a second wire harness 17.

In view that the logging while drilling tool is used in the downhole mud environment, the entire plug-in electrical connection structure has to be protected with the pressure-resistant shell 12, which is sealed with the first logging while drilling tool via two rubber seal rings 5 to prevent mud intrusion into the pressure-resistant shell, as shown in FIGS. 1-4.

In the entire insertion process, the radial guide bevel 2.3 on the plug guide 2.1 contacts with the socket guide bevel 1.2 first for radial guiding, which can be accomplished successfully as long as the radial deviation is within a range of 0-6.5 mm; during further insertion, the circumferential guide bevel 2.2 on the plug guide 2.1 contacts with the socket guide slot 1.3 for circumferential guiding, which can be accomplished successfully as long as the circumferential deviation is within a range of ±15°.

Figure 5:
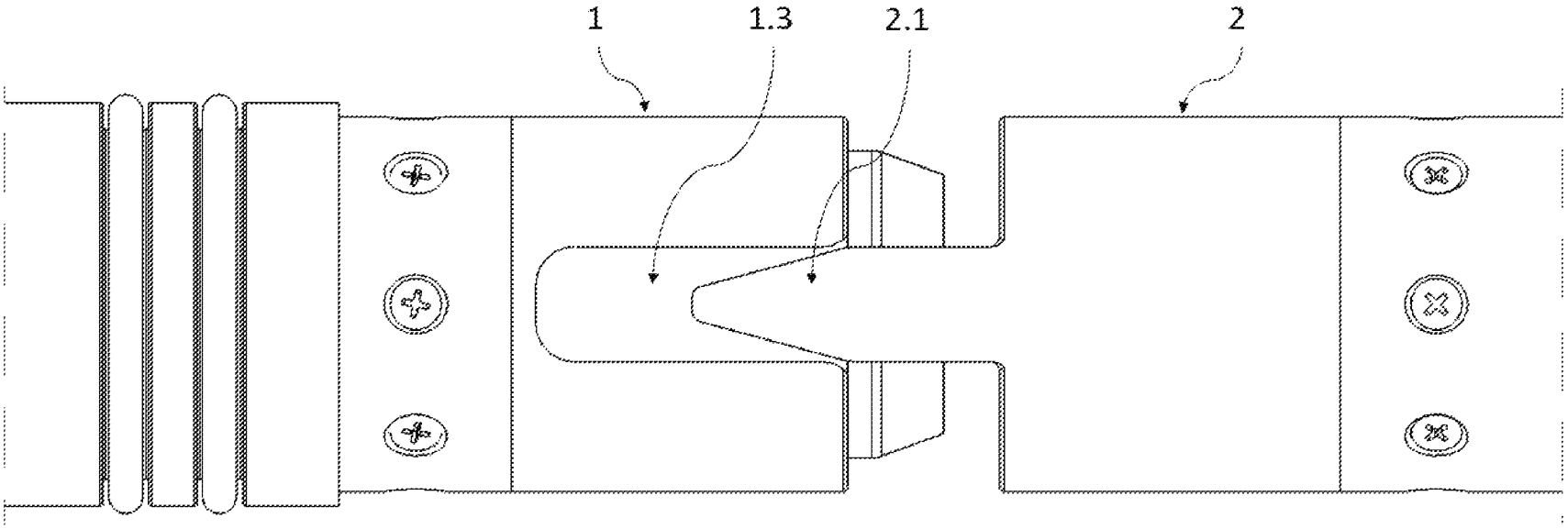
FIG. 5 is a schematic diagram illustrating the insertion of the multi-core plug-in electrical connection structure for logging while drilling tools according to the present invention.

After the plug and the socket are aligned, the plug inner core 13 is inserted into the socket inner core 7. The entire insertion process is completed after the plug shell 2 contacts with the end face of the socket shell 1, as shown in FIG. 5.

The socket shell 1 and the plug shell 2 are made of a structural steel material, which has high strength and can provide sufficient guiding force when it takes a guiding effect.

The multi-core plug-in electrical connection structure supports blind insertion. For example, when two logging while drilling tools (i.e., a first logging while drilling tool and a second logging while drilling tool) are to be butt-jointed in a drill collar where the insertion process can't be visually observed, the insertion can be carried out simply by roughly aligning the reference lines of the multi-core direct-insertion electrical connection structures at the connection ends of the first logging while drilling tool and the second logging while drilling tool respectively. Therefore, the radial and circumferential deviation allowance of the insertion is great, and the insertion is convenient and reliable.

We claim:

1. A multi-core plug-in electrical connection structure for logging while drilling tools, comprising: a socket shell with a guiding function arranged at a connecting end of a first logging while drilling tool and a plug shell with a guiding function arranged at a connecting end of a second logging while drilling tool, wherein the socket shell comprises a socket inner core with a buffering effect therein; and the plug shell comprises a plug inner core with a buffering effect, wherein the socket inner core is mounted inside the socket shell via a first flexible connection assembly, and the plug inner core is mounted inside the plug shell via a second flexible connection assembly, and the socket inner core and the socket shell as well as the plug inner core and the plug shell are positioned with respect to each other by a positioning key and a positioning keyway, respectively, wherein a socket guide slot is arranged on a side wall of an end of the socket shell, and a plug guide configured to be fitted with the socket guide slot is arranged on a side wall of an end of the plug shell opposite to the socket shell, wherein an end of the plug guide comprises a circumferential guide bevel for guiding in the circumferential direction for blind insertion of the plug into the socket and a radial guide bevel for guiding in the radial direction for blind insertion of the plug into the socket, wherein an included angle between the circumferential guide bevel and a horizontal direction is 0-15°, and a length of the circumferential guide bevel in the horizontal direction is 15-20 mm, and wherein an included angle between the radial guide bevel and the horizontal direction is 0-10°, and a length of the radial guide bevel in the horizontal direction is not smaller than 15 mm.

2. The multi-core plug-in electrical connection structure for logging while drilling tools according to claim 1, further comprising a pressure-resistant shell sleeves over the entire plug-in electrical connection structure, having two ends respectively sealed with the connecting end of the first logging while drilling tool and the connecting end of the second logging while drilling tool by rubber seal rings.

3. A multi-core plug-in electrical connection structure for logging while drilling tools, comprising: a socket shell with a guiding function arranged at a connecting end of a first logging while drilling tool and a plug shell with a guiding function arranged at a connecting end of a second logging while drilling tool, wherein the socket shell comprises a socket inner core with a buffering effect therein; and the plug shell comprises a plug inner core with a buffering effect, wherein the socket inner core is mounted inside the socket shell via a first flexible connection assembly, and the plug inner core is mounted inside the plug shell via a second flexible connection assembly, and the socket inner core and the socket shell as well as the plug inner core and the plug shell are positioned with respect to each other by a positioning key and a positioning keyway, respectively, wherein a socket guide slot is arranged on a side wall of an end of the socket shell, and a plug guide configured to be fitted with the socket guide slot is arranged on a side wall of an end of the plug shell opposite to the socket shell, and wherein a bottom of the socket guide slot comprises a socket guide bevel for guiding in the radial direction for blind insertion of the plug into the socket, an included angle between the socket guide bevel and a horizontal direction is 15-25°, and a length of the socket guide bevel in the horizontal direction is 5-10 mm.

4. A multi-core plug-in electrical connection structure for logging while drilling tools, comprising: a socket shell with a guiding function arranged at a connecting end of a first logging while drilling tool and a plug shell with a guiding function arranged at a connecting end of a second logging while drilling tool, wherein the socket shell comprises a socket inner core with a buffering effect therein; and the plug shell-comprises a plug inner core with a buffering effect, wherein the socket inner core is mounted inside the socket shell via a first flexible connection assembly, and the plug inner core is mounted inside the plug shell via a second flexible connection assembly, and the socket inner core and the socket shell as well as the plug inner core and the plug shell are positioned with respect to each other by a positioning key and a positioning keyway, respectively, wherein a socket guide slot is arranged on a side wall of an end of the socket shell, and a plug guide configured to be fitted with the socket guide slot is arranged on a side wall of an end of the plug shell opposite to the socket shell, wherein the first flexible connection assembly comprises a first top ring, a first wave spring and a first locking nut, wherein the first locking nut is arranged inside a tail end of the socket shell, one end of the first wave spring is fixedly connected with the first locking nut, one end of the first top ring is fixedly connected with the other end of the first wave spring, and the tail end of the socket inner core is fixedly connected with the other end of the first top ring, second flexible connection assembly comprises a second top ring, a second wave spring and a second locking nut, and wherein the second locking nut is arranged inside the tail end of the plug shell, one end of the second wave spring is fixedly connected with the second locking nut, one end of the second top ring is fixedly connected with the other end of the second wave spring, and the tail end of the plug inner core is fixedly connected with the other end of the second top ring.

5. The multi-core plug-in electrical connection structure for logging while drilling tools according to claim 4, wherein a compression amount of both the first wave spring and the second wave spring is that 3-5 mm of compression generates 100-180 N pre-tightening pressure.

6. The multi-core plug-in electrical connection structure for logging while drilling tools according to claim 1, wherein the socket shell and the plug shell are made of a structural steel material.

7. The multi-core plug-in electrical connection structure for logging while drilling tools according to claim 2, wherein the pressure-resistant shell is made of a structural steel material.

* * * * *